United States Patent [19]

Mack

[11] B 3,998,360

[45] Dec. 21, 1976

[54] DISPENSER COMBINED WITH HANGING CLIP FOR INVERTED SUPPORT

[75] Inventor: Frank J. Mack, Kinnelon, N.J.

[73] Assignee: American Home Products Corporation, New York, N.Y.

[22] Filed: Mar. 27, 1975

[21] Appl. No.: 562,601

[44] Published under the second Trial Voluntary Protest Program on March 16, 1976 as document No. B 562,601.

[52] U.S. Cl. ..... 222/181; 215/100 R; 248/360

[51] Int. Cl.[2] ..... A47K 17/02; B65D 23/12

[58] Field of Search ..... 222/180, 181, 185; 215/100 R, 100 A; 4/227; 248/359, 360

[56] References Cited

UNITED STATES PATENTS

| | | | |
|---|---|---|---|
| 3,627,177 | 12/1971 | Marcus et al. | 222/181 |
| 3,768,684 | 10/1973 | Buchtel | 222/181 X |
| 3,778,850 | 12/1973 | Bryan | 248/360 X |
| 3,883,024 | 5/1975 | Thomas | 222/181 X |

*Primary Examiner*—Drayton E. Hoffman
*Assistant Examiner*—Joseph J. Rolla
*Attorney, Agent, or Firm*—Joseph Martin Weigman

[57] ABSTRACT

The disclosure is directed to the combination of a container for dispensing liquid from an inverted position and a hanger device for suspending the container in an inverted position from the wall of a water closet. The hanger device consists of a planar member connected to a flanged cylindrical shaft eccentrically of the center of rotation of the shaft and opposite the flanged end. Recesses are defined in the side wall of the container to retain the shaft and in the end wall of the container to receive the planar member. The planar member and shaft swivel so that the planar member may be moved from a position where it is substantially flush with the container out to a position where it will engage the top of a wall of a water closet. The length of the shaft and the size of the recesses relative to one another may be such that the hanger device merely rotates in the recesses or such that the hanger device both rotates and reciprocates in the recesses.

8 Claims, 8 Drawing Figures

JUL 19 1976
FIG. 2
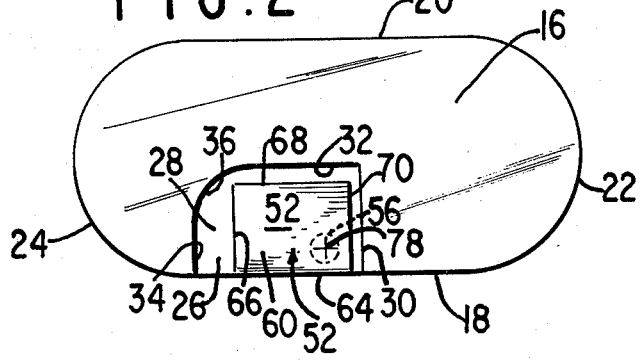
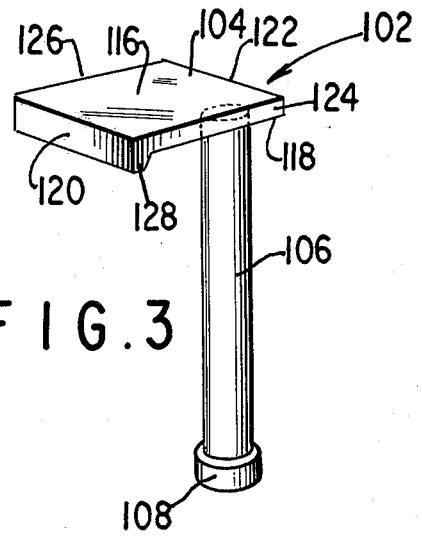
FIG. 3
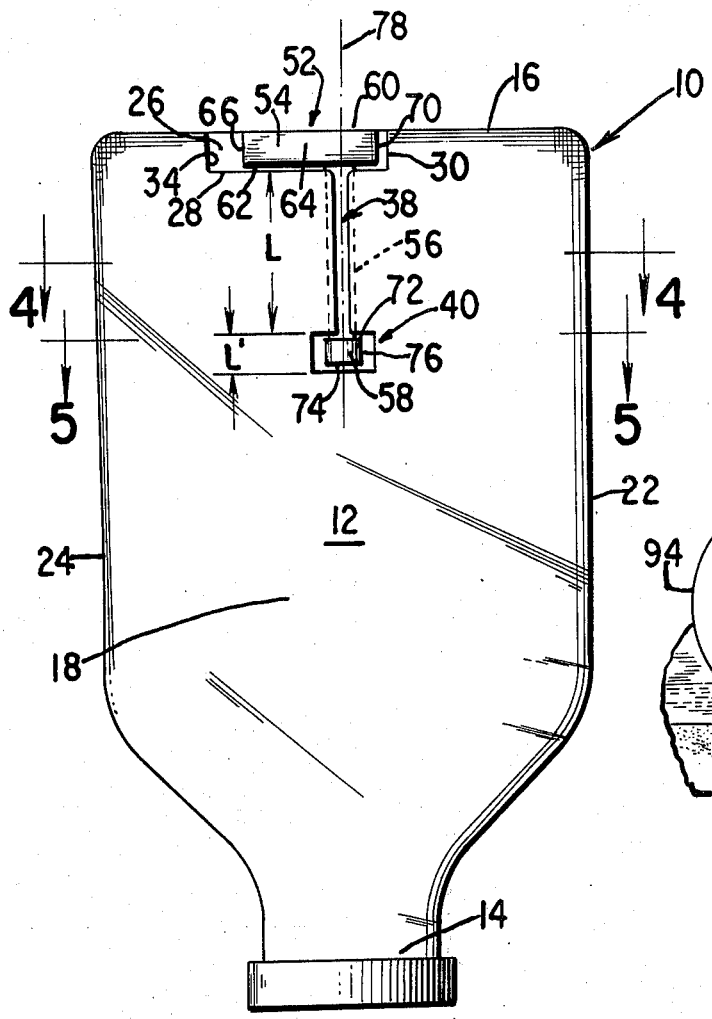
FIG. 1
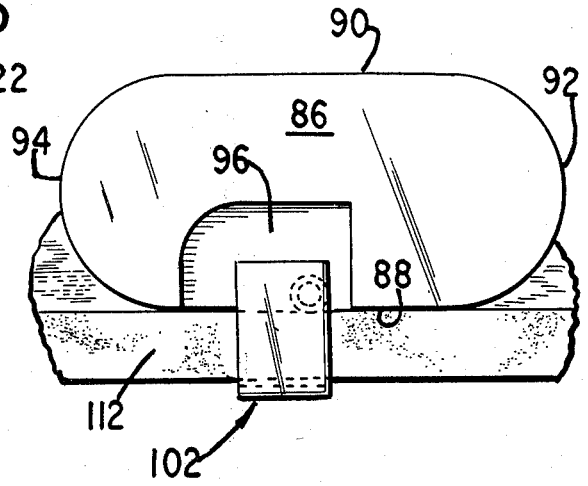
FIG. 7

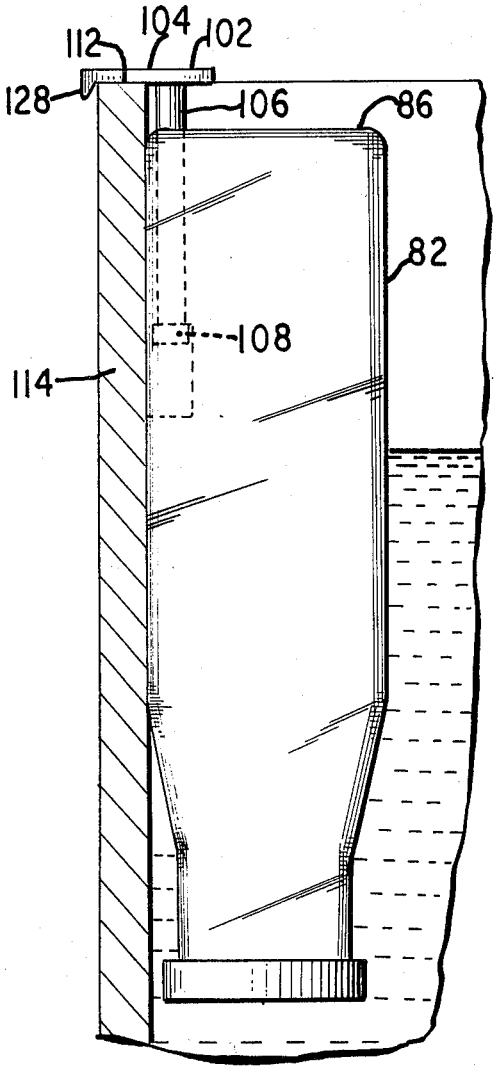
FIG. 8
FIG. 4
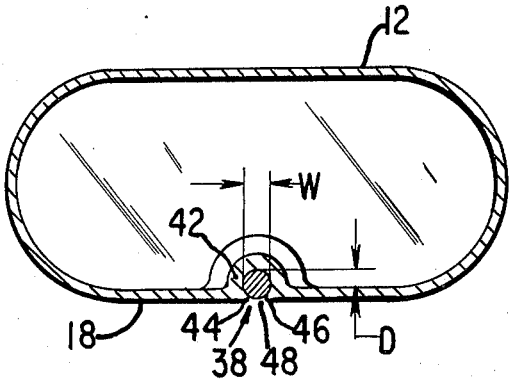
FIG. 5
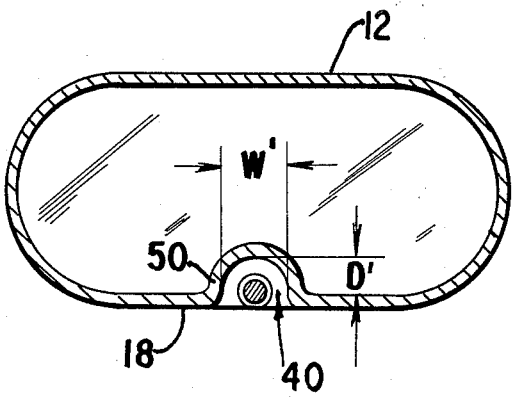

DISPENSER COMBINED WITH HANGING CLIP FOR INVERTED SUPPORT

This invention relates to dispensing containers and more particularly relates to the combination of a container adapted for automatic dispensing of its contents in an inverted position and a hanger device for firmly supporting the dispensing container in an inverted position.

Many compositions are sold for the treatment of water in a water closet. Many of the compositions are sold in containers which have a dispensing mechanism that is adapted to automatically discharge measured portions of the composition in response to varying levels in the water closet. That is, a measured amount of the composition is discharged each time the water closet is flushed. Many of these containers are fitted with hanger devices to suspend the container in an inverted position. Some hanging devices are clips of metal having a portion which may be bent into shape to fit the water closet wall by the user. Some hanger devices are plastic or metal which slide in and out of a groove located in the end wall. Other hanger devices are plastic coated wire which are made to be bent over the water closet wall. Still other hanger devices swivel or rotate into position and require the formation of feet on them in order to maintain the support for the container in an upright position, such as when displayed on a shelf prior to sale. Other swivel or rotating type clips have been limited to use with elliptical containers.

The most closely related U.S. patents are U.S. Pat. No. 2,980,277, which is typical of the devices having a deformable metal strip hanger, U.S. Pat. No. 3,627,177 which utilizes an L-shaped clip reciprocably movable in a groove, and U.S. Pat. No. 3,698,021 which also uses an L-shaped bracket reciprocable in a slot.

It is an object of the present invention to provide a support device in a container adapted to dispense in an inverted position, in which the container is an easily moldable dispenser and has a minimum of critical tolerances.

It is another object of the present invention to provide a combination hanging device and container which is adaptable to be held in tight engagement with a supporting wall.

It is another object of the present invention to provide a simply formable hanger device which swivels from a closed position for shipping and storage to an open position for use.

It is still another object of the invention to provide a support device for holding a container in an inverted position at a predetermined distance below the point of support.

Other and further objects of the invention will be apparent to those skilled in the art from reading the following description in conjunction with the drawings in which:

FIG. 1 is an elevational view of a dispensing container utilizing a hanger device of the present invention;

FIG. 2 is a bottom view of the container of FIG. 1;

FIG. 3 is a perspective view of a hanger device of the invention;

FIG. 4 is a sectional view taken generally along lines 4—4 of FIG. 1;

FIG. 5 is a sectional view taken generally along lines 5—5 of FIG. 1;

FIG. 7 is a top view of the container and hanging device shown in use on a water closet wall; and FIG. 8 is a side elevational view of the container embodiment of FIG. 6, shown in use in a water closet.

Figure 6:
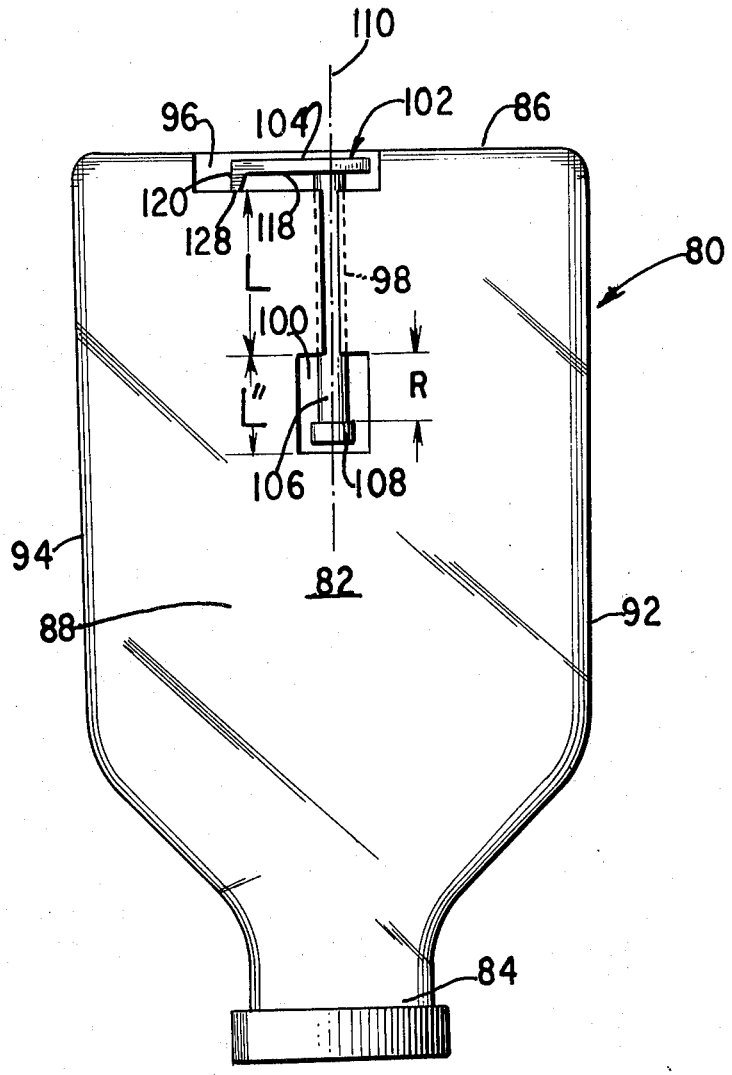
FIG. 6 is an elevational view of an alternate embodiment of a container utilizing a hanger device of the present invention.

The objects of the invention may be achieved with an assembly 10 for supporting a container 12 in an inverted position, as may be seen in FIG. 1. The container 12 has a discharge orifice 14 at one end, an end wall 16 at the opposite end and a plurality of side walls 18, 20, 22 and 24. It is preferred that at least one of the side walls be substantially planar as is side wall 18. The preferred shape of the container is oval, as may be seen in FIG. 2, having two planar side walls 18 and 20 and two semicircular walls 22, 24.

A first recess 26 is defined in the end wall 16 adjacent the side wall 18. The first recess has a planar base portion 28 and planar side walls 30, 32 and 34. While the recess may be rectangular in shape, it is preferable that one of the side walls 36 be arcuate.

As may best be seen in FIGS. 1, 4 and 5 the side wall 18 has defined in it a second recess 38 and a third recess 40. The second recess 38 is preferably located centrally on the side wall 18 and extends from the first recess 26 to the third recess 40. As may be best seen in FIG. 4, the second recess 38 has a predetermined depth D and a predetermined width W defined by an arcuate wall 42. The outermost edges of the recess 38 have linear ridges 44, 46 to define an opening 48 which is narrower than width W. While the second recess may be square or rectangular, the preferred shape is circular as shown in FIG. 4. The length of the second recess 38 is identified as L in FIG. 1.

The third recess 40, as may be seen in FIG. 5, is defined by an arcuate wall 50 to have a depth D′ and a width W′. As may be seen in FIG. 1 the height of the third recess 40 is identified as L′. While the shape of the third recess may be rectangular or square, it is preferred, as shown in FIG. 5, that it be substantially semicircular.

In comparing the sizes of the second and third recesses it will be noted that the width W′ of the third recess 40 is greater than the width W of the second recess 38 and that the depth D′ of the third recess 40 is greater than the depth D of the second recess 38. The second recess 38 and the third recess 40 taken together constitute a means to support a hanger device.

The hanger device 52, as may be seen in FIGS. 1 and 2, is made up of a first planar portion 54, a cylindrical shaft 56 and a flange 58. The cylindrical shaft 56 is eccentrically connected to the first planar portion 54. In the embodiment of FIGS. 1 and 2, the planar portion is a substantially flat, rectangular member, having upper planar portion 60 and lower planar portion 62, and side walls 64, 66, 68 and 70. Preferably the height of the side walls 64, 66, 68 and 70 is substantially equal to the height of the side walls 30, 32, 34 and 36 of the first recess 26. Therefore in the preferred embodiment, the upper planar portion 60 is substantially even with the surface of the end wall 16. This feature enhances the stability of the container when stored in an upright position prior to use.

Also, in the embodiment of FIGS. 1 and 2 the length of the cylindrical shaft 56 is substantially equal to the length L of the second recess 38. As may be seen in FIG. 1, the flange 58 is defined by an upper surface 72, a lower surface 74 and side wall 76. In the embodiment of FIGS. 1 and 2 the upper and lower surfaces 72 and 74, respectively, are larger than the width W of the second recess 38 but are smaller than the width W′ of the third recess 40. The hanger device 52 is inserted into position in the second recess 38 by pushing the cylindrical shaft 56 against the flexible linear ridges 44, 46, so that the hanger device 52 snaps into the second recess 38. Once in position as shown, the hanger device may be swivelled around the axis 78 of the cylindrical shaft 56. Because of the relative sizes of the members in the embodiment of the FIGS. 1 and 2 the hanger device 52 is limited to swiveling about the axis and does not substantially move up or down, that is reciprocate, with regard to the container.

In another advantageous embodiment the hanger device both swivels and reciprocates relative to the container as may be seen in FIG. 6. There the assembly 80 is made up of a container 82, having a discharge orifice 84 at one end, and an end wall 86 at the other end. In between are a plurality of side walls 88, 90, 92 and 94 as may be seen in FIG. 7. A first recess 96 is defined by the members similar to those of the first recess 26, as described above. The second recess 98, is also similar to the second recess 38, as described above. However, the third recess 100 while having a width W′ and a depth D′ similar to that of the third recess 40, as defined above, has a substantially greater length L″.

The hanger device 102 generally consists of a planar portion 104, a cylindrical shaft 106 and a flange 108. The cylindrical shaft 106 is connected to the planar portion 104 at a predetermined distance from the geometrical center of planar portion 104. The flange 108 may be substantially similar to the flange 58, as described above. The cylindrical shaft 106 is longer than the cylindrical shaft 56 by an amount R. The length R is the distance that the hanger device 102 will travel in reciprocating from a first position shown in FIG. 6 to a second position such as shown in FIG. 8.

After the hanger device 102 has been snap fitted into place in the second recess 98 it may swivel around its axis 110, and it may also reciprocate upwardly and downwardly in the first, second and third recesses by a distance R.

With the hanger device 102 extended, as may be seen in FIGS. 7 and 8, the planar portion 104 may be swivelled to extend across an upper surface 112 of a wall 114 of a water closet. Normally the hanger device 52 or 102 is swivelled to the closed position similar to that shown in FIG. 2 for packing, shipping and storage.

A more detailed perspective view of the hanger device 102 is shown in FIG. 3 where the planar portion 104 is modified somewhat from the planar portion 54 of the embodiment in FIGS. 1 and 2. The planar portion 104 has an upper surface 116, and a lower surface 118, and side walls 120, 122, 124 and 126. A flange 128 is formed integrally in the lower surface 118 adjacent to the side wall 120. The purpose of the flange 128, as may be seen in FIG. 8, is to engage the outer side of a water closet wall 114 to prevent the assembly 80 from slipping out of position. The height of the side wall 120 is preferably equal to the depth of the first recess 96, but as shown in FIG. 6 it may be less than that, if desired. An advantage of the reciprocating embodiment is that the container 82 is supported so that the end wall 86 is well below the upper surface 112 of the water closet wall 114. This embodiment minimizes the likelihood of conflict with a water closet cover.

The components of the assembly may be formed from any materials which will permit their fabrication and use as described. The preferred materials are semi-rigid plastics.

What is claimed is:

1. An assembly for supporting a container in an inverted position comprising:

A. a container having a discharge orifice at one end, an end wall at the opposite end, and a plurality of side walls between said ends;
  1. a first recess defined in said end wall adjacent a side wall;
  2. means to support a hanger device comprising second and third recesses defined in said adjacent side wall;
    a. said second recess extending between said first recess and said third recess and having a predetermined depth, width and length and having outer linear ridges extending toward each other to define a linear opening narrower than the width of said second recess;
    b. said third recess having a predetermined depth, width and length, said depth and width being larger than the depth and width of said second recess; and B. a hanger device rotatably connected to said support means and further comprising;
  1. a first planar portion adapted to swivel in said first recess;
  2. a cylindrical shaft connected eccentrically to said first planar portion being substantially equal in length to the length of said second recess and adapted to rotate in said second recess;
  3. a first flange connected to said shaft opposite said first planar portion and adapted to rotate in said third recess, said flange being wider than said second recess.

2. An assembly as defined in claim 1 in which the thickness of said first planar portion is substantially equal to the depth of said first recess.

3. An assembly as defined in claim 1 wherein the length of said third recess is substantially equal to the thickness of said first flange.

4. An assembly for supporting a container in an inverted position comprising:

A. a container having a discharge orifice at one end, an end wall at the opposite end, and a plurality of side walls between said ends;
  1. a first recess defined in said end wall adjacent a side wall;
  2. means to support a hanger device comprising second and third recesses defined in said adjacent side wall;
    a. said second recess extending between said first recess and said third recess and having a predetermined depth, width and length and outer linear ridges extending toward each other to define a linear opening narrower than the width of said second recess;
    b. said third recess having a predetermined depth, width and length, said depth and width being larger than the depth and width of said second recess;

B. a hanger device rotatably and reciprocably connected to said support means and further comprising:
  1. a first planar portion adapted to swivel in said first recess;

2. a cylindrical shaft connected eccentrically to said first planar portion and having a length greater than the length of said second recess, and being adapted to rotate and reciprocate in said second recess;

3. a first flange connected to said shaft opposite said first planar portion and adapted to rotate and reciprocate in said third recess, said flange being larger in diameter than said second recess; and C. said third recess length extending beyong said second recess by an amount substantially equal to the amount by which said hanger shaft is longer than the length of said second recess.

5. An assembly as defined in claim 4 further comprising a second flange defined on one side wall of said first planar portion opposite said shaft and extending in the same direction as said shaft.

6. An assembly as defined in claim 5 wherein the combined depth of said planar portion and second flange is substantially equal to the depth of said first recess.

7. An assembly as defined in claim 4 wherein the length of said third recess is greater than the thickness of said first flange and determines the extent of reciprocation of said support means with regard to said end wall.

8. An assembly as defined in claim 4 wherein said adjacent side wall is substantially planar.

* * * * *